US008072391B2

(12) United States Patent
Guo et al.

(10) Patent No.: US 8,072,391 B2
(45) Date of Patent: Dec. 6, 2011

(54) ANTENNA STRUCTURE

(75) Inventors: Yan-Liang Guo, Taipei (TW); Ching-Hui Chen, Linkou Township, Taipei County (TW); Chia-Yuan Liu, Taichung (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 374 days.

(21) Appl. No.: 12/509,657

(22) Filed: Jul. 27, 2009

(65) Prior Publication Data

US 2010/0265154 A1 Oct. 21, 2010

(30) Foreign Application Priority Data

Apr. 16, 2009 (CN) ..... 2009 1 0038777

(51) Int. Cl.
*H01Q 1/42* (2006.01)

(52) U.S. Cl. ..... 343/872; 343/900

(58) Field of Classification Search ..... 343/872, 343/900, 702

See application file for complete search history.

(56) References Cited

U.S. PATENT DOCUMENTS

| | | | | |
|---|---|---|---|---|
| 2,546,026 | A * | 3/1951 | Coon | 174/86 |
| 2,558,763 | A * | 7/1951 | Lee | 267/152 |
| 2010/0194664 | A1* | 8/2010 | Blickle | 343/888 |
| 2011/0004205 | A1* | 1/2011 | Chu et al. | 606/33 |

* cited by examiner

*Primary Examiner* — Tan Ho

(74) *Attorney, Agent, or Firm* — Rabin & Berdo, P.C.

(57) ABSTRACT

The antenna structure is applied for a communication system. The antenna structure has a signal emitting/receiving portion, a flex transmitting line disposed under the signal emitting/receiving portion and electrically connected to the signal emitting/receiving portion, and a connecting portion having a first end and a second end. The first end of the connecting portion is electrically connected to the flex transmitting line, and the second end of the connecting portion is connected to an assembling portion. The antenna structure further includes a bendable piece corresponding to the flex transmitting line. The bendable piece can be bent by a force to change positions, directions, or positions and directions of the signal emitting/receiving portion connected with the flex transmitting line. The bendable piece, the flex transmitting line and the signal emitting/receiving portion are covered by a sheath.

10 Claims, 3 Drawing Sheets

ANTENNA STRUCTURE

BACKGROUND OF THE INVENTION

1. Field of the Invention

The present invention relates to an antenna structure. In particular, the present invention relates to an exterior antenna structure which can be bent.

2. Description of Related Art

Antenna is widely used for improving the signal emitting/receiving in wireless communication system. Antennas can be classified into two categories which include micro built-in antenna and exterior antenna. The advantages of the built-in antenna include smaller size of the antenna and protection of the antenna. However, the built-in antenna cannot be rotated to face a direction which is aligning the direction of the signals. On the contrary, the exterior antenna can be rotated to adjust its position and direction to obtain stable signals. Therefore, the exterior antenna is more used in the wireless communication system.

Please refer to FIG. 1; the exterior antenna 11' of the wireless router has an antenna pole 12'. The antenna pole 12' has an antenna module (not shown) thereinside for emitting or receiving signals. The base of the antenna pole 12' has a connection portion 120'. One end of the connection portion 120' is connected to the antenna module and the other end of the connection portion 120' is connected to the wireless router station. The antenna pole 12' can be rotated on the connection portion 120'. There is a rotating shaft mechanism 13' between the antenna pole 12' and the connection portion 120'. The rotating shaft mechanism 13' has a shaft 130' and a base 131'. Therefore, the antenna pole 12' also can be bent depending on the rotating shaft mechanism 13' so that the exterior antenna 11' can be adjusted in various positions and directions.

The exterior antenna 11' is used for radiating signal to define an internet signal coverage Personal computers and laptop computers in the connection area can receive the signals to connect to the network.

The signal strength is usually shown in monitor so that users can know the signal strength. When the signal strength is weak, users can obtain the improved signals by adjusting the position and direction of the antenna. For example, user can rotate the antenna pole 12' with the connection portion 120' or bend the exterior antenna 11' with the rotating shaft mechanism 13' or the combination of above methods to improve the signal strength.

However, the traditional antenna has following disadvantage. The bending of the exterior antenna 11' by the shaft 130' is a one-direction bending because of the rotating shaft mechanism 13'. It's necessary to rotate the antenna pole 12' with the connection portion 120' in advance and then the exterior antenna 11' can be bent in another direction. Therefore, it costs more time and movements to adjust the position and the direction of the exterior antenna 11'.

Moreover, the traditional antenna has more components, such as shaft 130' and a base 131', and the components are manufactured and assembled together to achieve the adjustment of the antenna. Thus, it's necessary to reduce the volume and the manufacturing cost of the antenna to meet the requirement of small size and light weight of the wireless equipment.

Therefore, in view of this, the inventor proposes the present invention to overcome the above problems based on his expert experience and deliberate research.

SUMMARY OF THE INVENTION

One particular aspect of the present invention is to provide an antenna structure. The antenna structure can be bent in various directions without exterior devices.

The antenna structure is applied for a communication system. The antenna structure has a signal emitting/receiving portion, a flex transmitting line disposed under the signal emitting/receiving portion and electrically connected to the signal emitting/receiving portion, and a connecting portion having a first end and a second end. The first end of the connecting portion is electrically connected to the flex transmitting line, and the second end of the connecting portion is connected to an assembling portion. The antenna structure further includes a bendable piece corresponding to the flex transmitting line. The bendable piece can be bent by a force to change positions, directions, or positions and directions of the signal emitting/receiving portion connected with the flex transmitting line. The bendable piece, the flex transmitting line and the signal emitting/receiving portion are covered by a sheath.

The antenna structure is applied for a communication system. For example, the wireless router system includes a wireless router station and the antenna structure of the present invention. The wireless router system can be applied for connecting with desktop computer or laptop computer so that the computers can connect to the internet. Users can know the signal quality shown on the displaying monitor so that user can adjust the position or angle of the antenna structure for obtaining better transmission signals. In other words, when the wireless signal is not good, user can rotate the antenna structure or bend the antenna structure in various directions vertical to the axial direction of the antenna structure. Therefore, the position or the direction of the antenna structure can be adjusted for improving the signal quality so that user can connect internet more stable. At least one bendable piece is provided in the antenna structure for replacing the rotating shaft of the traditional antenna. Therefore, the problem that the rotating shaft only can be bent in one direction is solved. In other words, the antenna structure can be bent in various directions so as to improve the signal transmission.

Furthermore, the components of the traditional antenna structure are simplified. In other words, the assembly of the antenna structure of the present invention is optimized so that the size and the volume of the antenna structure of the present invention are reduced. The bendable piece and the signal emitting/receiving portion are covered by the sheath so that the components are not exposed. Furthermore, the manufacturing process of the antenna structure is optimized. The bendable piece is provided into the mold and the antenna structure can be formed in one procedure so that the manufacturing processes are simplified and the manufacturing cost is reduced.

Moreover, the elastic force of the sheath is less than the deformation force of the bendable piece when the antenna structure is bent so that the bendable piece is fixed in a predetermined position and direction. In other words, when the bendable piece is bent as well as the sheath, the elastic force of the sheath is generated opposite to the deformation force of the bendable piece. In the condition that the elastic force of the sheath is less than the deformation force of the bendable piece, the bendable piece can be fixed in a predetermined position and toward a predetermined direction without any exterior auxiliary tools so as to obtain stable signals.

The sheath has a concave portion corresponding to the bendable piece so that user can bend the antenna structure. User can hold the concave portion so as to bend the bendable piece. Therefore, the concave portion performs as an operation space so that it's convenient for users to bend the antenna structure.

The concave portion has anti-slide structure thereon, for example, a concave-convex continuous anti-slide pattern, for noticing the bending position for users. Furthermore, the anti-slide structure is used for preventing the hand of the user from sliding when the user is forcing on the bendable piece.

One end of the bendable piece is connected to the first end or the second end of the connecting portion. Therefore, the bendable piece can not shift after many times of being bent because of the fixed end of the bendable piece.

In one embodiment, one end of the bendable piece can be welded on the connecting portion.

The bendable piece can be a stainless steel line-material. Preferably, the line-material has higher bendy capability than the pipe-material. Therefore, the bendable piece can be bent many times and the life time of the antenna structure is increasing. The elastic force of the sheath is less than the deformation force of the bendable piece when the antenna structure is bent so that the bendable piece is fixed in a predetermined position and direction.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
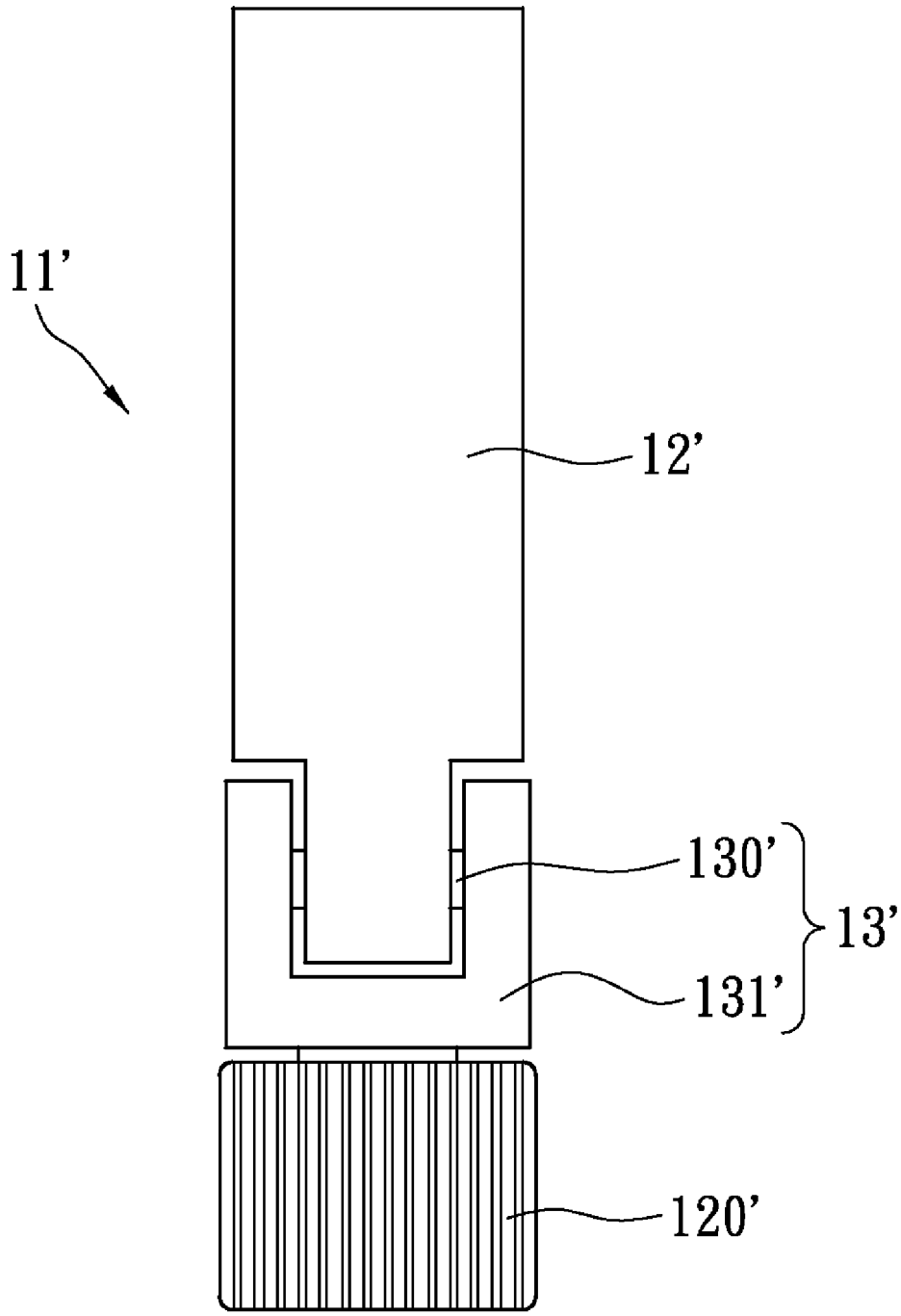
FIG. 1 PRIOR ART
FIG. 1 is a schematic diagram of a traditional antenna.
Figure 2:
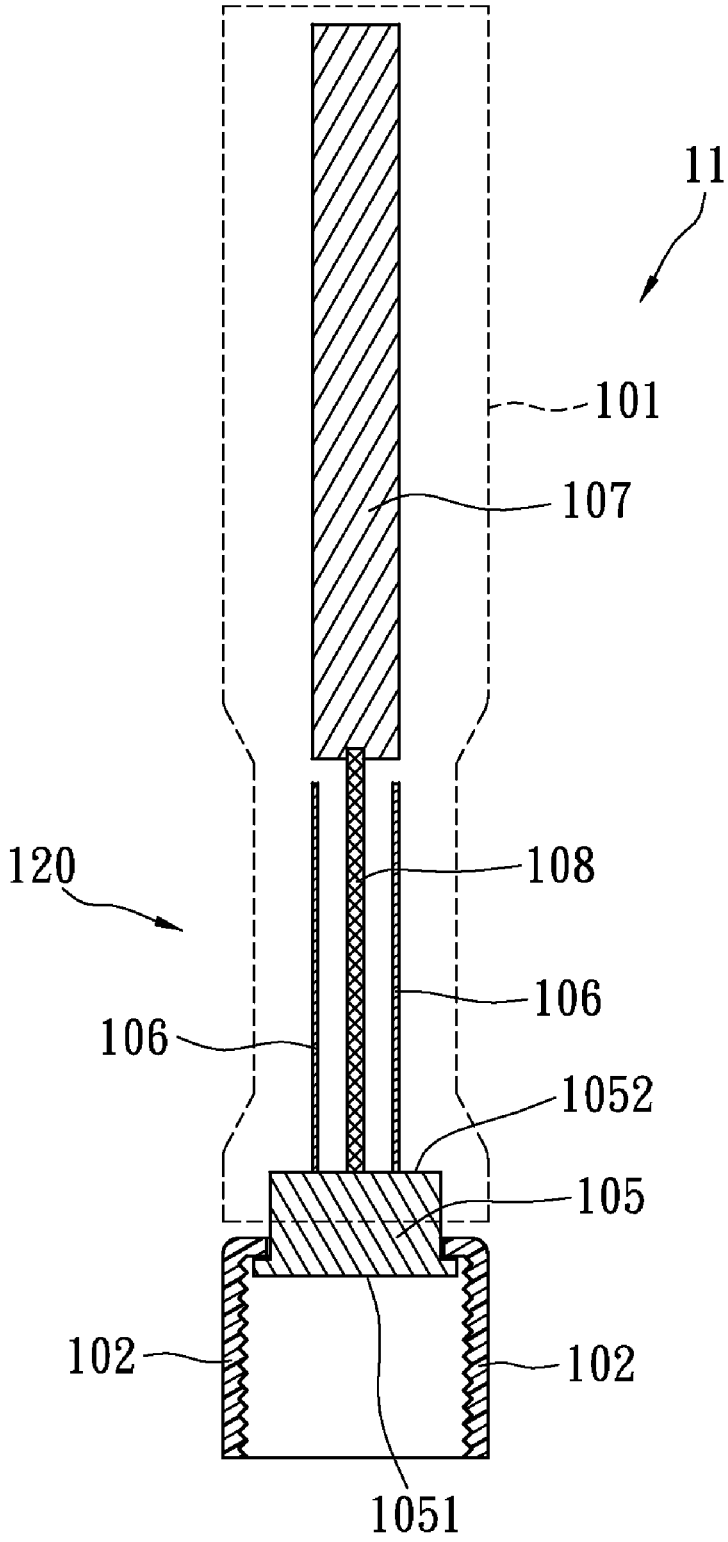
FIG. 2 is a schematic diagram of the antenna structure of the present invention.
Figure 3:
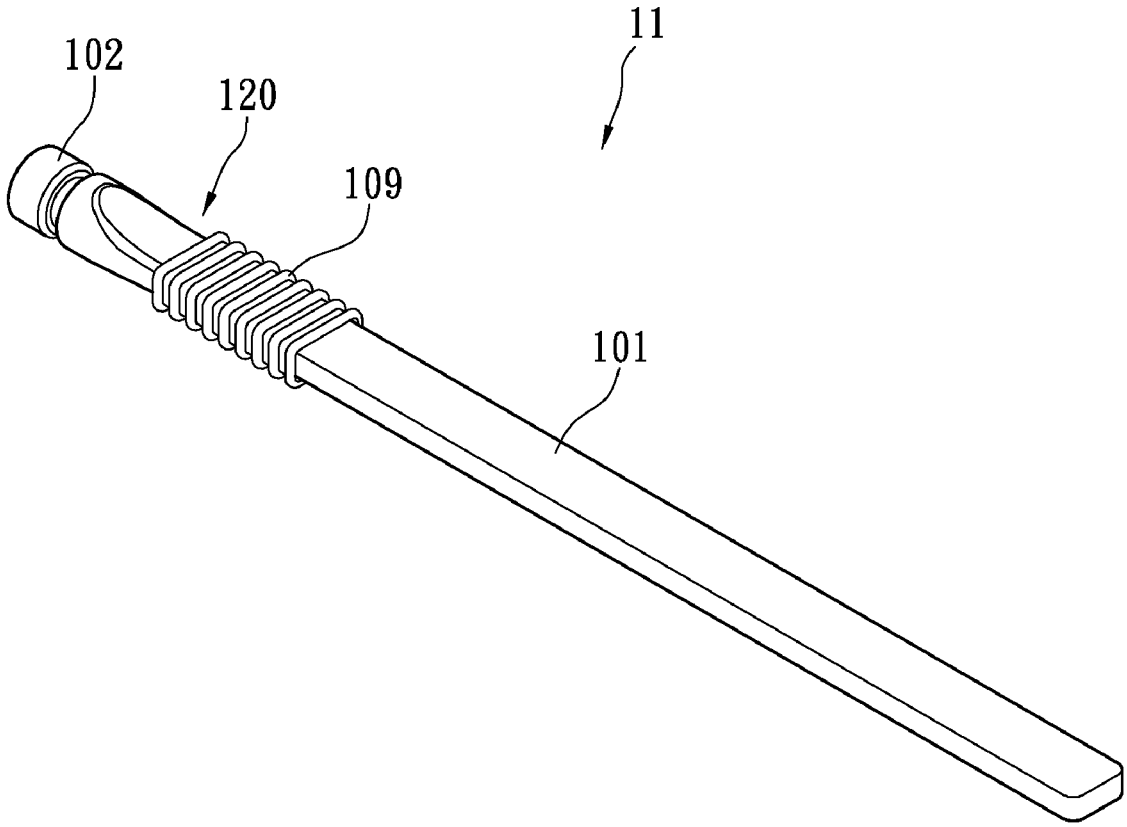
FIG. 3 is a schematic diagram of the outer structure of the antenna structure of the present invention.

Reference is made to FIGS. 2 and 3. The present invention provides an antenna structure 11 which can be applied to a communication system, such as a wireless router (not shown). The router is a networking device and can be used for applying for networking signals so that computers covered in the signals can have connectivity for internet. The wireless router can use for encoding the received signals and emitting the transformed internet signals so that the internet signal coverage is formed.

The antenna structure 11 has an assembling portion 102 which can be used for fixing the antenna structure 11 on the router. Please refer to FIG. 2; the assembling portion 102 has screw threads so that the assembling portion 102 can be fixed on the router by a screwing manner. Preferably, the antenna structure 11 has standard screw threads for connecting to the router, therefore the antenna structure 11 has capability for assembling on other networking devices without re-designing. In addition, the antenna structure 11 further has a connecting portion 105. The second end 1051 of the connecting portion 105 is connected to the assembling portion 102 by a screwing manner. The first end 1052 of the connecting portion 105 is connected electrically to a flex transmitting line 108 and the flex transmitting line 108 is connected electrically to a signal emitting/receiving portion 107, for example by a welding method. The signal emitting/receiving portion 107 is disposed on a PCB by a method which is well known in the industry.

The antenna structure 11 further includes a bendable piece 106 which is disposed under the signal emitting/receiving portion 107 as shown in FIG. 2, and the bendable piece 106 is disposed outside the flex transmitting line 108. A sheath 101 is used for covering the bendable piece 106, the flex transmitting line 108, and the signal emitting/receiving portion 107. Moreover, the sheath 101 is connected with the assembling portion 102 so as to form an integral structure. When a force is used to press the sheath 101 on the bendable piece 106, the antenna structure 11 can be bent repeatedly due to the material characteristics. The bendable piece 106, the flex transmitting line 108, and the signal emitting/receiving portion 107 are covered by the sheath 101 (as the dotted line in FIG. 2), so that the position and the direction of the signal emitting/receiving portion 107 are changed by bending the bendable piece 106. Therefore, the signal covering area and zone are changed. One end of the bendable piece 106 is fixed on the first end 1052 of the connecting portion 105, in other words, the other end of the bendable piece 106 is a free end. Therefore, the bendable piece 106 is free to be bent in the direction vertical to the axial direction. In other words, the movement of the bendable piece 106 is not limited in the direction vertical to the axial direction.

Alternatively, one end of the bendable piece 106 can be connected to the second end 1051 of the connecting portion 105. For example, the end of the bendable piece 106 is welded on the second end 1051 so as to prevent the position of the bendable piece 106 from shifting. Therefore, the transmission quality of the antenna can be maintained.

The sheath 101 can be made of soft materials, such as rubber material, plastics or elastic materials so that the sheath 101 can be easily bent repeatedly. Moreover, the sheath 101 has high reliability for being bent. In other words, the materials of the sheath 101 are not restricted but meeting the requirement of elasticity and protection of the interior components, such as signal emitting/receiving portion 107. In an embodiment, the sheath 101 is formed by injection-molding method to cover the interior components. It is necessary to hold the position of the bendable piece 106 after bending the bendable piece 106. The sheath 101 has an elastic force and the bendable piece 106 has a deformation force when the bendable piece 106 is forced on. In balance, the elastic force is less than the deformation force so that the bendable piece 106 is fixed in a predetermined position and direction. In other words, the bendable piece 106 can be bent and be hold in the bent state by no exterior tools or force to transmit signals with high quality.

In the embodiment, two bendable pieces 106 of metal are disposed respectively on two sides of the flex transmitting line 108 so as to balance the deformation force.

When the router is turned on to connect with network, a high frequency current is generated so as to transfer the electrical signals to networking signals. Personal computers or laptop computers can be used for receiving and transmitting signals to the network system. Users can know the signal strength by watching the indication displayed on the monitor. When the signal strength is weak or non-stable to lead the decreased transmission, user can adjust the position and direction of the antenna structure 11. The antenna structure 11 can be repeatedly adjusted and then be held in a predetermined position and direction so that the improved transmission quality is provided.

The sheath 101 is provided for covering the bendable piece 106, signal emitting/receiving portion 107 and flex transmitting line 108 and the structure can be manufactured by a simplified method. The bendable piece 106 is provided inside the mold and the structure can be integrally formed. The traditional shaft can be omitted so as to decrease the manufacturing cost.

Users are often force on the bendable piece 106 so as to bend the antenna structure 11 to obtain improved and higher signals. Preferably, the bendable piece 106 is manufactured by line-material of stainless steel. The line-material of stainless steel has longer life for being bent than the pipe-material. Therefore, the bendable piece 106 of line-material of stainless steel is used for improving the using life of the antenna structure 11.

In an embodiment, there are two bendable pieces 106 disposed on two sides of the flex transmitting line 108 for the reason of force balance. Alternatively, there can be only one bendable piece 106 disposed adjacently to the center of the antenna structure 11. Still alternatively, there are more than two bendable pieces 106 and the number of the bendable pieces 106 can be even or odd. The number and the structure of the bendable pieces 106 can be customized depending on the practice applications.

The antenna structure 11 is also can be used for receiving signals, therefore the antenna structure 11 of the present invention can be connected with another communication apparatus for receiving signals. Depending on the signal direction, the antenna structure 11 is forced to adjust its position and direction so as to improve the receiving of the signals. In other words, the antenna structure 11 of the present invention can be used in wireless router and another communication device or apparatus.

The bendable pieces 106 can be made of another metal line-material, such as copper and metal materials with bendy capability. The integral structure of the bendable pieces 106 is line-shaped and has ability of being bent. In other words, the bendable piece 106 is not restricted as a pure row material.

Please refer to FIG. 3; the sheath 101 has a concave portion 120 corresponding to the bendable piece 106. The concave portion 120 has a concave shape contrary to the periphery of another portion of the sheath 101. Furthermore, the concave portion 120 has anti-slide structure thereon, for example, a concave-convex continuous anti-slide pattern 109, for noticing the bending position for user. In other words, it is convenient for user to bend the bendable piece 106 on the concave portion 120 so that the position and the direction of the antenna structure 11 can be adjusted by forcing on the bendable piece 106. Please refer to FIG. 2; the bendable piece 106 is located on the base portion of the antenna structure 11 and is adjacent to the assembling portion 102. Furthermore, the bendable piece 106 is covered by the sheath 101 and the concave portion 120 performs as an indication position so that user can bend the bendable piece 106 efficiently.

Please refer to FIG. 3; the antenna structure 11 is a pole-shaped structure as well as the sheath 101. However, the pole-shaped antenna structure 11 can be planar, cylindrical, oval-shaped, or combination of the above-mentioned shapes.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An antenna structure applied for a communication system, comprising: a signal emitting/receiving portion, a flex transmitting line disposed under the signal emitting/receiving portion and electrically connected to the signal emitting/receiving portion, and a connecting portion having a first end and a second end, the first end of the connecting portion electrically connected to the flex transmitting line, the second end of the connecting portion connected to an assembling portion, the assembling portion electrically connected with the communication system, the antenna structure further including a bendable piece corresponding to the flex transmitting line, the bendable piece being bent by a force to change positions, directions, or positions and directions of the signal emitting/receiving portion connected with the flex transmitting line, and the bendable piece, the flex transmitting line, and the signal emitting/receiving portion being covered by a sheath.

2. The antenna structure as claimed in claim 1, wherein the sheath has an elastic force and the bendable piece has a deformation force, the elastic force is less than the deformation force so that the bendable piece is fixed in a predetermined position and direction when the bendable piece is forced on.

3. The antenna structure as claimed in claim 1, wherein the sheath has a concave portion corresponding to the bendable piece.

4. The antenna structure as claimed in claim 3, wherein the concave portion has anti-slide structure thereon.

5. The antenna structure as claimed in claim 1, wherein the bendable piece has one end fixed to the first end of the connecting portion.

6. The antenna structure as claimed in claim 1, wherein the bendable piece has one end welded to the second end of the connecting portion.

7. The antenna structure as claimed in claim 1, wherein the bendable piece is made of a metal material.

8. The antenna structure as claimed in claim 7, wherein the metal material is a stainless steel.

9. The antenna structure as claimed in claim 1, wherein the sheath is made of an elastic material.

10. The antenna structure as claimed in claim 9, wherein the elastic material is a rubber material or plastics.

* * * * *